US006205748B1

(12) United States Patent
Daniele et al.

(10) Patent No.: US 6,205,748 B1
(45) Date of Patent: Mar. 27, 2001

(54) SUTURE PACKAGE UNLOADING ARRANGEMENT IN A MACHINE FOR THE AUTOMATED PACKAGING OF NEEDLES AND ATTACHED SUTURES

(75) Inventors: Robert A. Daniele, Flemington; Anthony Esteves, Somerville, both of NJ (US)

(73) Assignee: Ethicon, Inc., Somerville, NJ (US)

( * ) Notice: Subject to any disclaimer, the term of this patent is extended or adjusted under 35 U.S.C. 154(b) by 0 days.

(21) Appl. No.: 09/020,192

(22) Filed: Feb. 6, 1998

(51) Int. Cl.[7] ..... B65B 63/04
(52) U.S. Cl. ..... 53/430; 53/18
(58) Field of Search ..... 53/430, 118, 235, 53/473; 414/790.2, 789.6, 791.6

(56) References Cited

U.S. PATENT DOCUMENTS 5,487,216 * 1/1996 Demarest et al. ..... 53/118
5,511,670 * 4/1996 Demarest et al. ..... 209/540
5,605,433 * 2/1997 Tanaka ..... 414/789.6
5,636,966 * 6/1997 Lyon et al. ..... 414/791.6
5,873,212 * 2/1999 Esteves et al. ..... 53/118

* cited by examiner

*Primary Examiner*—Stephen F. Gerrity
*Assistant Examiner*—Sam Tawfik
(74) *Attorney, Agent, or Firm*—Scully, Scott, Murphy & Presser

(57) ABSTRACT

A machine for the automated packaging of armed sutures or; in effect, surgical needles having sutures attached thereto and, more particularly, a suture package unloading arrangement and package unloading method employed in an automated machine for the high-speed individualized packaging of single or individual surgical needles each having an attached suture into a tray and detachable cover providing a suture package utilized for the packaging of the individual or single needles and attached sutures.

22 Claims, 13 Drawing Sheets

SUTURE PACKAGE UNLOADING ARRANGEMENT IN A MACHINE FOR THE AUTOMATED PACKAGING OF NEEDLES AND ATTACHED SUTURES

BACKGROUND OF THE INVENTION

1. Field of the Invention

The present invention relates to a machine for the automated packaging of armed sutures or; in effect, surgical needles having sutures attached thereto and, more particularly, pertains to a suture package unloading arrangement and package unloading method employed in an automated machine for the high-speed individualized packaging of single or individual surgical needles each having an attached suture into a tray and detachable cover providing a suture package utilized for the packaging of the individual or single needles and attached sutures. Additionally, the automated packaging machine incorporates operative mechanism adapted to wind the sutures into a peripheral channel of the tray and facilitating the attachment of the cover to the tray which contains the single needle and attached wound suture, and which cover concurrently constitutes a product-identifying label as a component of the tray. The cover being shaped such that removal of the cover is not necessary to enable a user to gain access to the contents of the tray; in essence, the armed suture.

The automated packaging machine also provides for a rotary turret or dial-like turntable for the high-speed loading thereof with empty trays; the sequential loading of successive forwardly indexed trays each with a needle and attached suture; the indexed advance of the needle and suture-filled tray to suture-winding stations of the machine; the conveyance of the trays each containing the needle and attached wound suture to a cover-applying station of the machine to provide the completed suture packages, and the further advance of the suture packages for subsequent automated removal of the completed suture packages from the machine. The automated packaging machine is resultingly adapted to provide for the continuous and repetitive production of suture packages in a single high-speed production cycle without necessitating any manual manipulation thereof.

More specifically, in the production of suture packages as described herein, the packaging machine pursuant to the present invention provides for a workstation which includes operative robotic pivot arm structure for transferring completed suture packages from tool nests mounted on a rotary dial to compartmented trays in a continues sequence, whereby the package-filled trays may be stacked and manually removed so as to be further transported for additional processing and/or storage, and replaced by empty compartmented trays in an automated sequence.

The present invention is also specifically directed to the provision of a novel method for the automated unloading from the machine of completed suture packages containing the packaging individual surgical needles and attached sutures, and transferring the suture packages into compartmented trays in a continously implemented sequential operation.

Currently, in the medical, surgical and health-related technology, the high-speed and efficient packaging of either single or multiple sutures which are each suitably attached to surgical needles, such as by being swaged or similarly fastened thereto, and in which such combined sets of needles and sutures are generally referred to as armed sutures, is imparted an increasing degree of importance in view of the rising demand of users for such combined surgical needles and attached sutures, and various diverse types of inexpensively manufactured suture packages for the containment of needles and attached sutures have been developed and are presently widely employed.

In specific instances, suture packages may be covered tray-shaped containers designed to receive and fixedly retain therein one or more needles and therewith attached sutures, in which the suture packages, upon opening of the covers, must enable the uncomplicated and simple withdrawal of a respective individual needle and its attached suture in a smooth unobstructed manner. In essence, when the needle which is to be removed from the suture package is engaged by a surgeon or health professional, for example, by being gripped through the intermediary of a forceps and then pulled out of the suture tray, it is essential that the needle easily disengage from its restraint in the package while the suture which is attached to the needle should also be readily able to slip out of the tray in the absence of any binding or snagging, and in the instance of the tray housing a plurality of armed sutures also without becoming entangled with other sutures still remaining in the suture tray or package. Thus, pursuant to a specific needle and suture package construction which, for example, may comprise an injection-molded plastic tray, the needles are generally engaged by clamping structure located in the tray so as to be "parked" or retained in predetermined position or array in a central region of the tray. The sutures extending from the needles to which they are attached are then conducted under tension and wound into a peripheral channel formed within the suture tray so as to extend along the peripheral interior within length of the channel. This positioning of the needles, and particularly that of the sutures within the peripheral channel of the tray is intended to eliminate tight bends or curves normally imposed on the sutures so as to facilitate their easy withdrawal from the suture package.

2. Discussion of the Prior Art

Until relatively recently, the introduction of needles with attached sutures into suture packages or molded plastic trays was being implemented in a substantially manual manner. In that instance, the needles were manually placed into the tray so as to be clampingly engaged by means of suitable needle-gripping structure, and thereafter the attached sutures wound or positioned within the confines of the tray. Subsequently, a suitable cover was superimposed upon and fastened to the filled tray, and the resultant armed suture package conveyed to a suitable arrangement for possible sterilizing or further over wrapping.

The foregoing essentially manual and relatively basic process for winding the sutures into the tray, and especially the locating thereof into the peripheral channel of the tray during manipulation of the tray, was quite time-consuming, and in conjunction with the manual application of the cover into the tray in a basically individual or piece-by-piece mode, represented a serious hindrance to a large volume or mass produced manufacturing output, and adversely affected the economics in attempting to provide such large quantities of suture packages containing either single or multiple surgical needles and attached sutures.

As an improvement over the foregoing, there was then developed a generally semi-automated winder machine for packaging surgical needles and attached sutures in a tray-like suture package, and wherein at least some of the previously manually implemented packaging steps were to some extent automated in order to be able to increase the output of needle and suture-containing packages while simultaneously reducing the number of manual procedures in effectuating the packaging of those particular items.

To that effect, the semi-automated winder machine, although necessitating the manual orientation of the trays for implementing the filling thereof with needles and attached sutures, included a winding station which to a considerable degree automated the winding process for the sutures so as to place the latter into a peripheral channel extending about the circumference of the tray. Also provided was a further therewith operatively associated device which enabled covers to be manually placed on the needle and suture-filled trays to be fastened thereto by means of a pressing die forming latchingly engaging interconnections between each of the covers and the trays, while concurrently producing from a portion of the cover a product-identifying label which remains permanently attached to the tray upon subsequent detachment of the cover. Although providing a considerable advance over the state-of-the-art in the packaging of needles and sutures, the semi-automated winder machine nevertheless necessitated the implementation of a considerable number of manual and labor-intensive handling steps in effectuating the filling of the trays with surgical needles and attached sutures, attaching the cover and, generally, producing complete suture packages.

As a further technological advance over the foregoing semi-automated needle and suture package-forming concept, there was then developed a substantially fully automated packaging machine which is adapted, in a highly efficient and extremely rapid mode, to continually fill successive trays of the type described hereinabove with pluralities of surgical needles and attached sutures, and subsequently causing the sutures to be wound into the confines of the tray, such as into a peripheral channel extending about the tray. Thereafter, the packaging machine was designed to implement the automated positioning and fastening of covers to the needle and suture-filled trays to produce completed suture packages of the type described hereinabove, which were then adapted to be transported to a suitable locale for selective further processing, such as sterilizing, and/or over wrapping, as is required by this technology.

In particular, the automated packaging machine was designed to provide the packages with each housing a plurality of needles and attached sutures. For example, the packaging machine for accomplishing the foregoing, which is commonly assigned to the assignee of the present application, is described in U.S. Pat. Nos. 5,487,212; 5,473,584; 5,469,689; 5,473,810; 5,511,670; 5,452,636; 5,438,746; 5,500,991; 5,477,609; 5,485,668; and 5,487,216.

The flat, tray-shaped suture package produced by the packaging machine set forth in the above-mentioned patents provides for the storage therein of multiple surgical needles and attached sutures, while concurrently recognizing the need to facilitate the smooth and unobstructed withdrawal of individual needles and attached sutures from the suture package. For instance, such a suture package is disclosed in applicants' U.S. Pat. No. 5,230,424, which is commonly assigned to the assignee of the present application; and wherein the suture package is referred to as an RSO package (Reduced Size Organizer).

In the specific design of the flat tray-shaped plastic container having a peripheral channel as disclosed in the above-mentioned patent, the suture package is basically constituted of a rectangular round-cornered and flat-bottomed injection-molded plastic tray having a flat central surface area including a raised needle clamping structure formed thereon for engaging and "parking" a plurality of needles in a predetermined spaced array. Sutures each have one end thereof attached to each of the respective needles so as to form so-called "armed sutures". The sutures extend from each of the needles into a channel extending about the perimeter or periphery of the suture tray and are conducted into the channel so as to be essentially wound within the circumferential confines of the suture tray. The plurality of sutures which are positioned within the suture tray channel are protected against inadvertent outward displacement therefrom through the presence of a multiplicity of contiguously positioned resilient fingers which are integrally molded with the suture tray, and which project outwardly above the confines of the channel along a major portion of the length of the channel and, collectively, form a so-called "zipper structure" in which the inherently resilient nature of the fingers facilitates their temporary raising up to enable the introduction of the sutures into the suture tray channel by means of a suitable suture winding apparatus.

Although the rotary dial or turntable apparatus of the packaging machine pursuant to the foregoing U.S. patents provides for the packaging of armed sutures; in effect, needles with attached sutures, in a rapid and fully automated manner, such as by supplying the tray-shaped packages; thereafter parking the plurality of armed sutures in the packages, applying covers and removing the completed suture packages from the machine in a sequential station-to-station procedure, the machine was designed to primarily produce suture packages each containing a plurality of armed sutures.

SUMMARY OF THE INVENTION

Pursuant to the present inventive concept, the above-mentioned automated packaging machine is further improved upon in a novel and unique manner in that the machine is adapted to produce suture packages each containing a single armed suture, such packages being frequently in demand rather than packages containing a plurality of needles and sutures. Thus, in order to provide for high production rates which are essentially compatible with those employed in the manufacture of suture packages each containing a plurality of armed sutures, the present invention contemplates the provision of a fully automated packaging machine with a considerably increased rate of operating speed and production capability so as to render the packaging machines economically viable in comparison with the previously described automated packaging machine, while maintaining structural and functional reliability and ease of construction and maintenance.

In order to attain the essentially automated packaging of singly-packaged or individual surgical needles with attached sutures, the automated packaging machine pursuant to the invention sets forth the provision of a rotary turret or dial-like turntable having a plurality of tool nests each possessing a suture tray supporting surface, with each tool next being circumferentially spaced about the turntable so as to be uniformly distributed about the periphery thereof. The rotary turret is rotated to cause the tool nests supporting packaging trays to be indexed forwardly so as to advance through a plurality of successive work stations which are adapted to, respectively, effectuate the supplying of each of the trays located on the tool nests or support surfaces with a single or individual surgical needle and attached suture, winding the suture into the confines of each needle and suture-containing tray, forming a latching engagement between a tray cover and the tray; and thereafter conveying each completed suture package to a station for removal from the machine and transfer to stacking bins or the like.

Operatively communicating in synchronism with the indexing rotation of the rotary turret is a carousel device housing stacks of trays, which is adapted to supply empty trays sliced or separated from the bottom of a respective stack of the trays to a rotatable platform, and includes operative robotic pivot arm structure to successively remove the trays from the rotatable platform and mount the empty trays on successive tool nests so as to be oriented in a vertical plane facing radially outwardly of the rotary turret. Thereafter, each tray is indexed sequentially forwardly by the rotary turret to a workstation which will impart movement to a portion of the tool nest having the tray supported thereon, whereby the tray remains oriented essentially vertically it is rotated angularly relative to the horizontal plane of rotation of the rotary turret. This movement enables a transfer device with a needle and suture swaging mechanism processing needle grippers at a further workstation to insert and position a surgical needle with its attached suture into a therewith aligned tray for retentive engagement with needle-engaging structure formed in the tray so as to grip and park the needle therein, with the suture extending from the needle and depending downwardly therefrom outwardly of the tray. The needle and suture-containing tray is then advanced forwardly on its respective tool nest to successive workstations responsive to indexed of the rotary turret wherein, at a first suture winding station, structure operatively cooperating with the tray and the tool nest supporting the tray imparts an initial rotational movement to the tray about an axis perpendicular to the plane of the while maintaining tray the depending suture under tension, and at a second subsequent winding station imparts a rapid winding motion to the tray over multiple predetermined rotations so as to fully wind the downwardly depending suture into a peripheral tray channel extending within the perimeter of the tray.

Thereafter, the tool nest mounting the tray with the needle parked therein and the attached suture which has been wound into the peripheral channel of the tray is advanced to a further workstation responsive to indexed rotation of the rotary turret; at which workstation an operating mechanism causes a bottommost cover to be sliced or separated from a stack of covers and transferred to a rotatable platform. The cover is then engaged by a robotically-controlled pivot arm which, under the action of a vacuum, pivots the cover into a vertical orientation and applies the cover onto the tray while concurrently imparting pressure to the cover to cause cooperating latching structure to clampingly fasten the cover to the needle and suture-containing tray. Upon completion of the cover-attaching sequence, the resulting completed suture package is indexed to a further workstation at which suitable pivoting gripper arm mechanism engages the suture package, and the suture package is disengaged from the tool nest on which it is supported and conveyed into compartmented trays so as to be transferred to and stacked in a repository or receiving unit to be readied for further processing, such as sterilizing, overwrapping or the like, as may be required.

The foregoing sequence of operative steps is continually repeated for each successive tool nest on the rotary turret or turntable sequentially receiving empty trays from the carousel, while preceding tool nests each mounting a tray are conveyed through the above-mentioned packaging cycle. Thus, a successive tray is always placed into a position of readiness at a following or subsequent workstation and processed in a similar manner as before described during the forward indexing motion of the rotary turret or turntable. This ensures a continuously repetitive packaging cycle for successive suture packages in a highly efficient and high-speed operation without the need for any manual intervention in the operation of the packaging machine.

Intermediate various of the workstations as set forth hereinbefore; there may be arranged other workstations incorporating sensors adapted to enable ascertaining the presence of empty trays at the initial workstation, for a verification of a needle having been inserted into the trays and for inspection of the trays subsequent to the winding of the sutures into the tray channels; checking for the application of the covers to the trays, and facilitating the possible ejection of incomplete trays or the removal from the machine of defective packages.

A particular aspect of the invention, resides in the provision of a suture package unloading station, wherein the completed suture package which has the suture needle and attached wound suture arranged therein, and with the cover having been previously applied thereto, is unloaded from the automated packaging machine through the intermediary of pivotable robotic arm structure and deposited into suitable compartmented trays in which a plurality of superimposed completed suture packages are stacked, with the compartmented trays being indexed upon the compartments being filled, and thereafter conveyed to a stacking arrangement while being replaced by empty compartmented trays.

Furthermore, pursuant to another feature of the invention, in the event of ascertaining that the suture package is either incomplete or defective, the latter is not removed from the tool nest at the unloading workstation, but is permitted to advance to a subsequent workstation, and at that location removed by a grippper mechanism and deposited on a conveyor belt for conveyance to a waste disposal site.

Accordingly, it is an object of the present invention to provide a package unloading arrangement for removing completed suture packages from the packaging machine through the intermediary of a robotic pivot arm structure, which transfers the package into compartmented trays for further storage and/or processing of the suture packages.

A further object resides in the provision of novel indexing compartmented trays for the receipt of stacked quantities of suture packages in each compartment whereby filled trays are shifted to a stacking arrangement while empty compartmented trays are automatically shifted into position for the receipt of suture packages from the packaging machine in a continous operating sequence.

Another object of the present invention resides in the provision of a method for unloading the completed suture packages from the automated packing machine, and stacking these in compartmented trays for further storage or processing of the suture packages.

Still another object resides in the provision of a workstation which receives and removes rejected suture packages from the automated packaging machine, in the event that such packages are not unloaded by the package unloading arrangement, but are adapted to be advanced to this reject workstation for removing the rejected suture packages from tool nests on which they are positioned and conveying them towards a disposal site.

BRIEF DESCRIPTION OF THE DRAWINGS

Reference may now be had to the following detailed description of a preferred embodiment of the invention, taken in conjunction with the accompanying drawings; in which.

DETAILED DESCRIPTION OF THE PREFERRED EMBODIMENT

Figure 1:
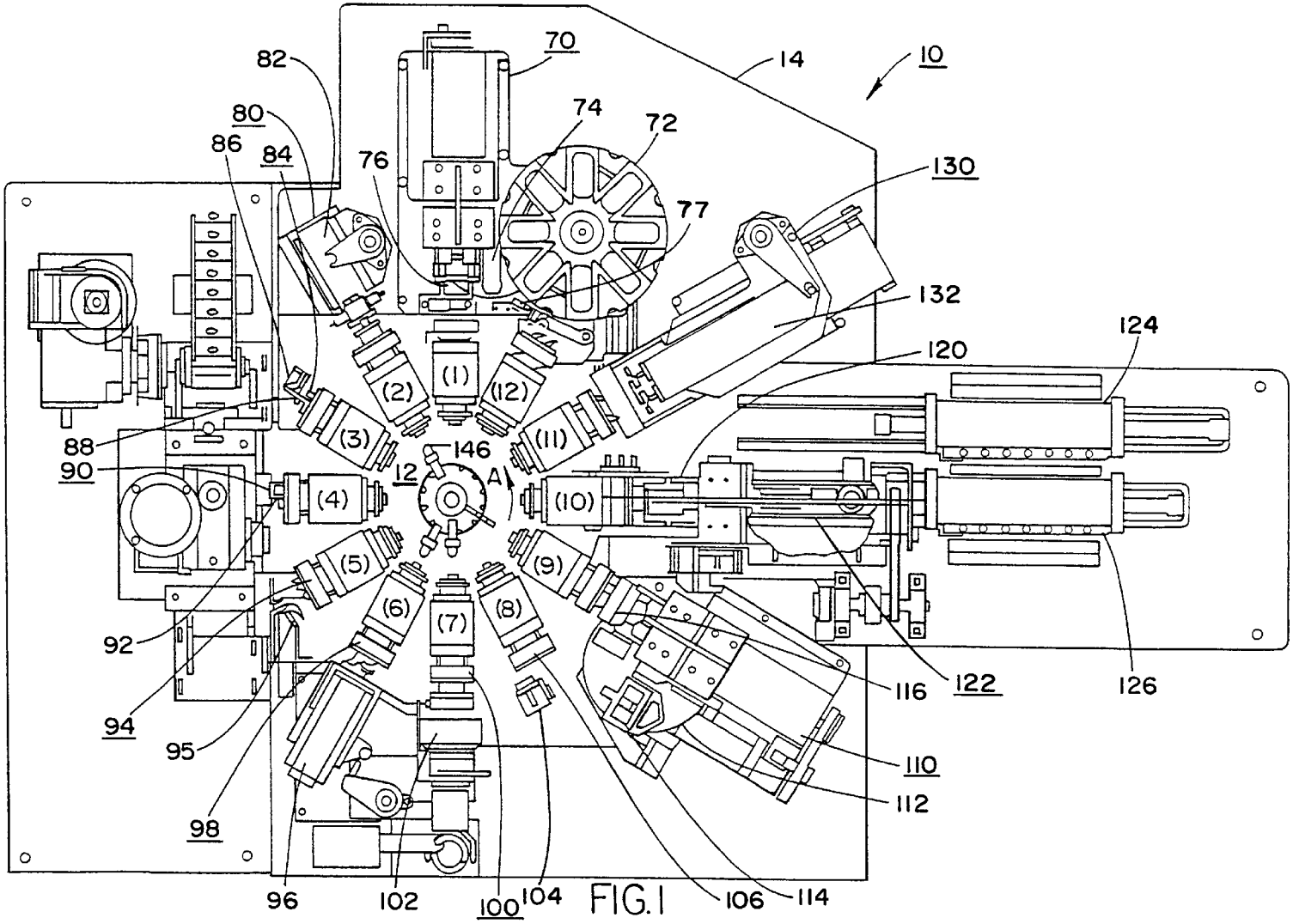
FIG. 1 illustrates, generally diagrammatically, a plan view of the machine for the automated packaging of individual surgical needles and attached sutures, pursuant to the present invention.
Figure 2:
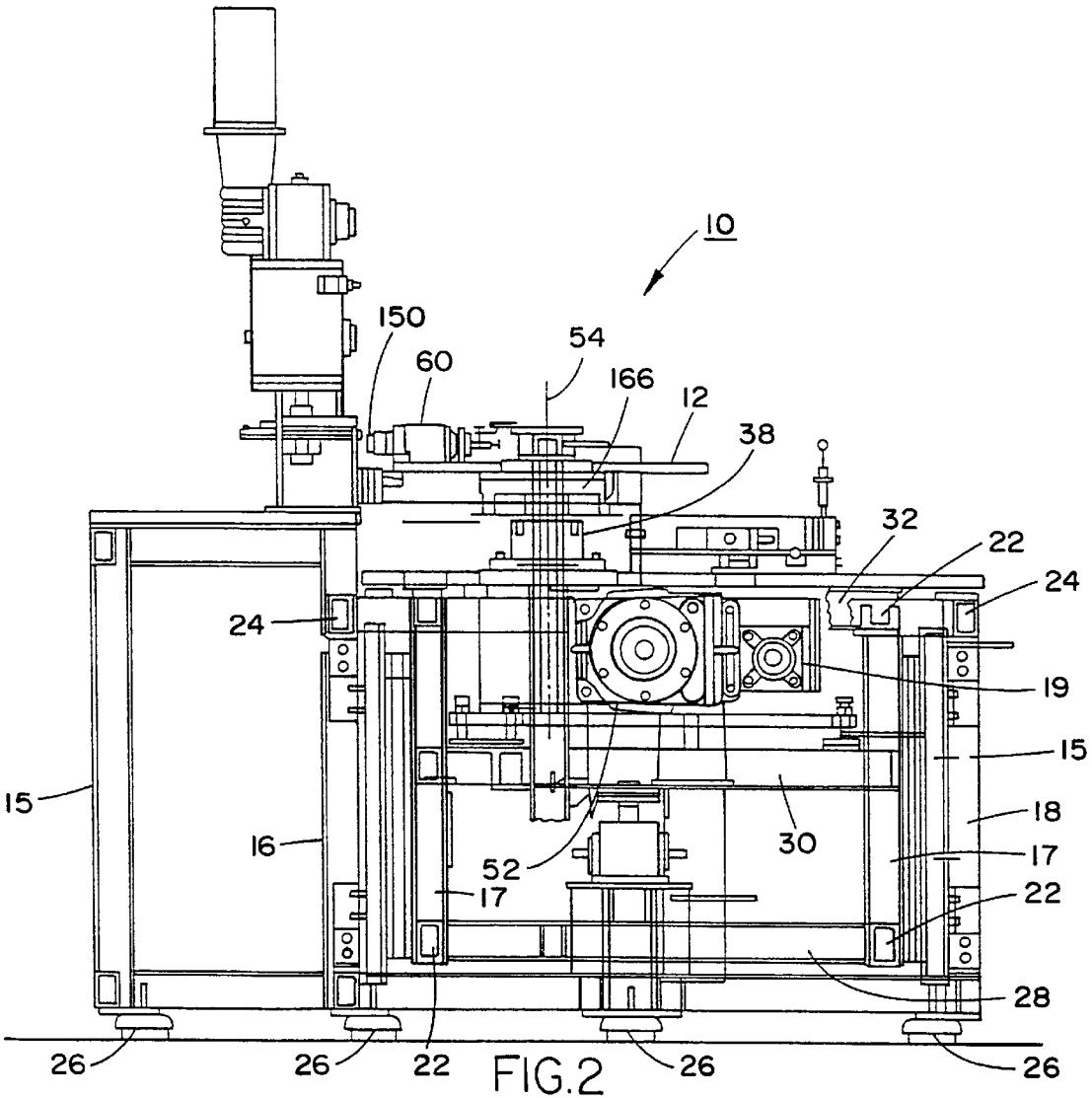
FIG. 2 illustrates a side elevational view of the machine frame of FIG. 1.
Figure 3:
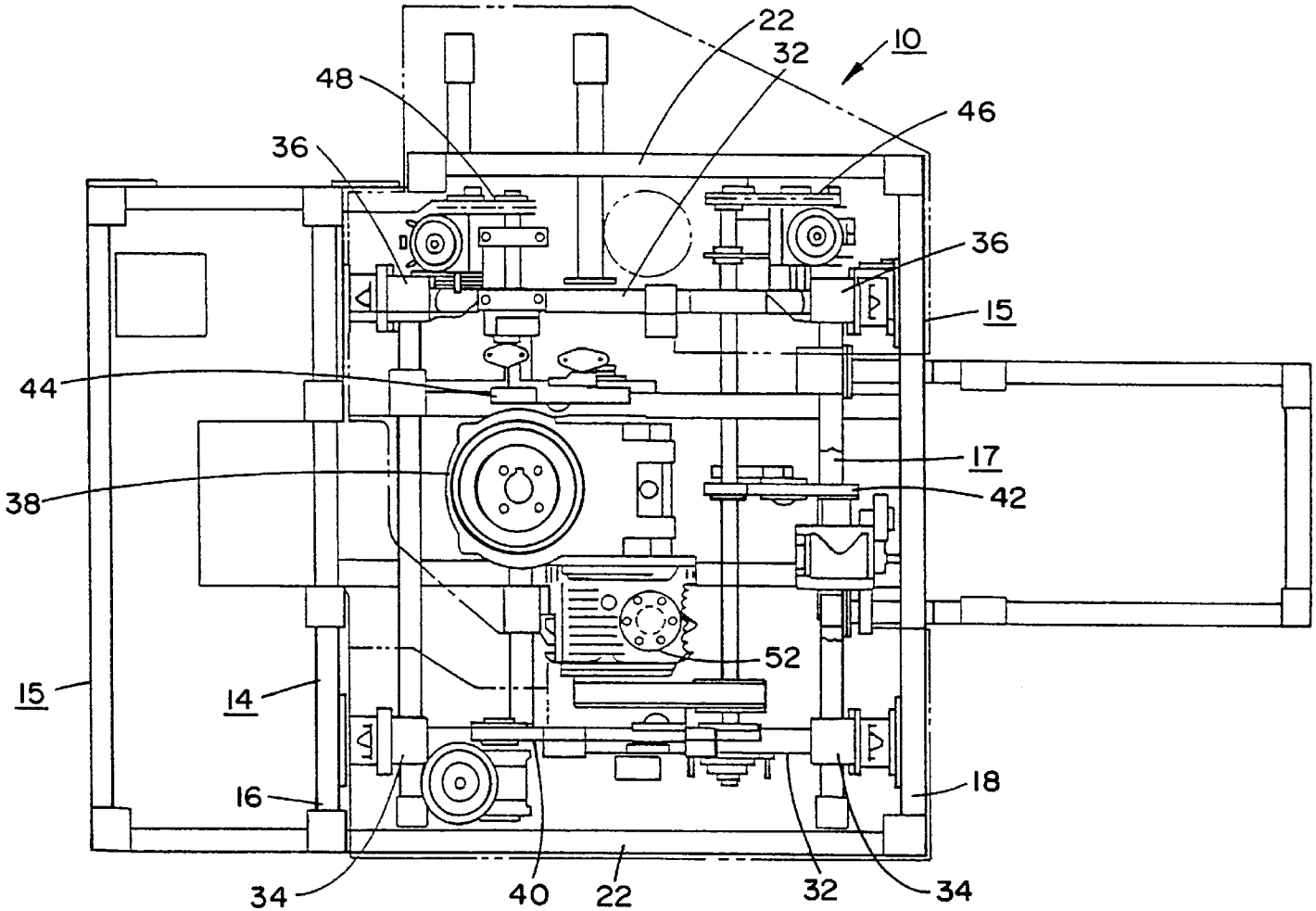
FIG. 3 illustrates a top plan view of the machine frame of FIG. 2.

Referring now in more specific detail to the drawings, FIGS. 1 to 3 illustrate, in a generally diagrammatic plan view, the automated needle and suture packaging machine 10 pursuant to the invention. The machine 10 comprises a rotary turret or turntable 12 which is essentially a packaging dial supported on an essentially stationary machine frame structure 14.

The rigid frame structure 14, as illustrated in FIGS. 2 and 3, basically includes structural uprights 16 and 18, which are interconnected by horizontal beams 20, 22, 24, with the entire frame structure 14 adapted to be supported on a floor through the intermediary of adjustable leveling footings 26. The frame structure 14 comprises an outer stationary frame arrangement 15, and an inner vertically adjustable frame arrangement 17 comprising horizontal beams 28, 30 and 32, and vertical beams 34, 36 interconnected therewith supporting the turntable 12 for vertical adjustment relative to the stationary machine frame components. The vertical adjustment of the frame arrangement 17 is provided for by a central servo motor actuated jack-screw 38, which also concurrently effectuates the vertical adjustment of all of the operative packaging devices at the various workstations of the machine so as to accommodate the packaging of a wide range of differently sized surgical needles without the necessity for modifying any machine components. Arranged within the frame structure are the various belt drives 40, 42, 44, 46 and 48 and operating drive components 50 for the machine, and the vacuum-generating systems 52 employed in the packaging cycles for the suture packages, as described hereinbelow. The turntable 12 is oriented in a horizontal plane, and through the intermediary of a program-controlled drive installation, is rotatable in an indexing or incrementally angular advance about a central vertical axis 54. In this instance, during operation of the machine, the turntable 12 is rotated in a counter-clockwise direction when viewed from above, as represented by arrow A, so as to be advanced in 30° increments.

The rotary turret or turntable 12 is essentially constituted of a circular disk-shaped member or packaging dial which has a plurality of tool nests 60 mounted thereon. The tool nests 60 are mounted in a circumferentially uniformly spaced array on the upper surface of the package dial or rotary turret 12, and with each tool nest 60 having an outer end projecting radially outwardly of the peripheral edge of the turret or dial 12, as described hereinbelow.

In this particular construction of the packaging machine 10, by way of example, twelve (12) tool nests 60 are arranged at uniformly distributed annular spacings of 30° from each other about the circumference of the dial or rotary turret 12.

In essence, as mentioned hereinbelow, the rotary turret or turntable 12 of the packaging machine 10 is adapted to be indexed forwardly in an angularly incremental or indexed rotational advance, each such incremental advance comprising one-twelfth of the 360° circumferential rotation of the turntable, or basically 30°, along the direction of rotation identified by arrow A in FIG. 1, such that the tool nests 60 which are each adapted to mount a suture tray or package are designed to be advanced in sequence to a number of successive workstations; designated herein as workstations (1) through (12), which are stationarily evenly spaced about the periphery of the rotary turret 12, as illustrated in FIG. 1 of the drawings.

The successive workstations which collectively constitute the automated machine 10 for the packaging of surgical needles and attached sutures are essentially briefly described as follows; viewed in the direction of rotation of arrow A:

(1) A first workstation 70 relates to the operative aspect of empty suture package trays being successively separated from the bottom of stacks of trays contained in a rotary carousel 72 to be transferred onto a rotationally indexed plate 74 under the action of a vacuum, and thereafter picked up and transferred by a cam-controlled robotic pivot arm structure 76 to successive tool nests 60 so as to be retained thereon while being conveyed by the rotary turret or dial 12 to subsequent workstations, as set forth hereinbelow.

(2) At this workstation 80, to which the respective tool nest 60 supporting the empty tray thereon has been advanced by the rotational advance of the turntable 12 mounting the tool nest; in effect, indexed 30° forwardly; operative slide-controlled pivot structure 82 engages a plate element on the outer end of the tool nest 60 which supports the empty tray under a vacuum, and rotates the plate element and tray counterclockwise within the vertical plane thereof about a horizontal radial axis of the tool nest 60 through an angle of approximately sixteen and one-half (16.5°) degrees so as to be in appropriate angular orientation relative to a horizontal axis for facilitating the subsequent insertion and retention of a surgical needle and attached suture into the tray.

(3) This workstation 84 provides for a sensor 86 which is mounted stationarily on a bracket arrangement 88 and faces the tool nest 60 so as to be able to check for the presence of an empty tray on the tool nest. The sensor 86 is suitably aimed at a black spot present on the packaging tooling nest, and in the absence of a tray being positioned thereon, enables deactivating the forward advance of the turntable 12 and concurrently may emit a signal to alert personnel regarding the missing tray.

(4) The next workstation 90 along the rotational path of motion of the turntable in the direction of arrow A, provides gripper mechanism 92 for inserting a single surgical needle and a therewith attached suture into the suture tray which has been indexed forwardly by the rotary turret 12 so as to be located in operative alignment with the needle-feed mechanism. The needles are conveyed by a mechanism so as to be mounted on suitable clamping or needle "park" structure constituting an integral portion of the tray. Vacuum-controlled suture capture and tensioning devices which are located below each tool nest 60, become operative at this workstation to capture and tension the suture portions depending outwardly and downwardly of the tray mounting the surgical needle.

(5) At this workstation 94, a stationary sensor 95 located radially outwardly of the turntable 12 may be utilized to ascertain the presence of a surgical needle and attached suture having been properly introduced into the tray at the previous workstation 90.

(6) A first tray winding mechanism 96 at this workstation 98 engages the plate element on the tool nest supporting the tray, while the suture capture and tensioning device ensures that the suture portion depending outwardly and downwardly from the tray is maintained under tension by a vacuum-operated tensioning device associated therewith, with the tray being rotated counterclockwise within its vertical plane through approximately 163.5°, to assume a horizontal orientation which is 180° inverse to its original orientation on the tool nest 60 at workstation (1), and with the remaining length of the suture being tensioned by the vacuum device externally of the tray.

(7) At a subsequent workstation 100, a further winding mechanism 102 engages the tool nest 60 and the tray mounted thereon, and imparts rapid rotation to the tray so as to enable tray structure engaging portions of the mechanism to introduce and completely wind the entire remaining length of the suture into a peripheral groove extending about the confines of the tray.

(8) A stationary sensor 104 at this workstation 106 is located radially outwardly of the turntable 12, and is adapted to ascertain the positioning of the surgical needle in the tray.

(9) This workstation 110 provides apparatus for the application and attachment of a cover or label to the tray containing the surgical needle and attached suture to produce or complete suture to produce a complete suture package. A rotatably indexed disc-like plate 112 includes a plurality of equidistantly circumferentially spaced cover-receiving areas, these being rotated below a vertical stack 114 of covers or labels such that, under the action of a vacuum, the bottommost covers of the stack are sequentially sliced off or separated and deposited into a respective area of the plate under the influence of the vacuum present therebeneath, and thereafter rotated into radial alignment with a tool nest 60 mounting the tray containing the surgical needle and attached wound suture. A cam-controlled robotic pivot arm structure 116 lifts the cover from the plate, while a subsequent area receives a further cover from the stack for transfer onto a following tray, and pivots upwardly and extends horizontally forwardly so as to position the cover into latching engagement with the tray, thereby forming the completed suture package.

(10) A robotic pivotable gripper arm 120 removes the completed package from the tool nest 60 at this subsequent workstation 122, and swings downwardly so as to deposit the completed suture package into receiving bins or compartments within elongated tray members 124 whereby upon a certain amount of trays being deposited to fill the tray member the latter is indexed to align a further empty compartment of a tray member with the tool nests. The tray member having the various filled compartments is then conveyed to a storage unit 126 and replaced automatically by another empty tray member.

(11) In the event of a suture package being defective, such as having a cover lacking or misplaced, and the resultant package has accordingly not been removed at the preceding package unloading workstation 122; at this workstation 130 a reciprocating arm structure 132 has a gripper head which engages and removes the rejected packages from the tool nests, and deposits them onto a conveyor belt 134 for conveyance to a suitable waste disposal site.

(12) A sensor 77 at the final workstation on the packaging machine 10 checks for the presence of a package that may not have been removed at stations (10) and (11). This is a further safegard built into the packaging machine to ensure that the tool nest at station (1) is empty and ready to accept an empty package tray.

Figure 6:
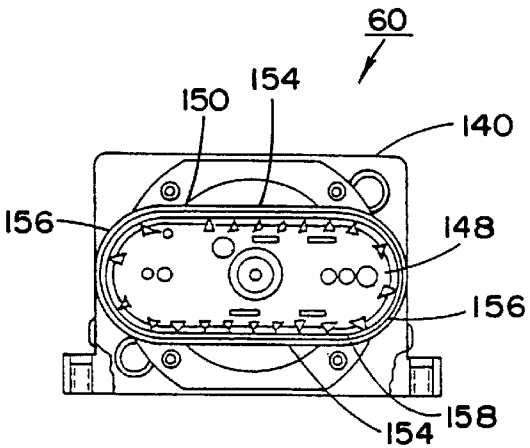
FIGS. 4, 5 and 6 illustrate, respectively, side, top plan and front end views of a tool nest utilized in the machine of FIG. 1.
Figure 4:
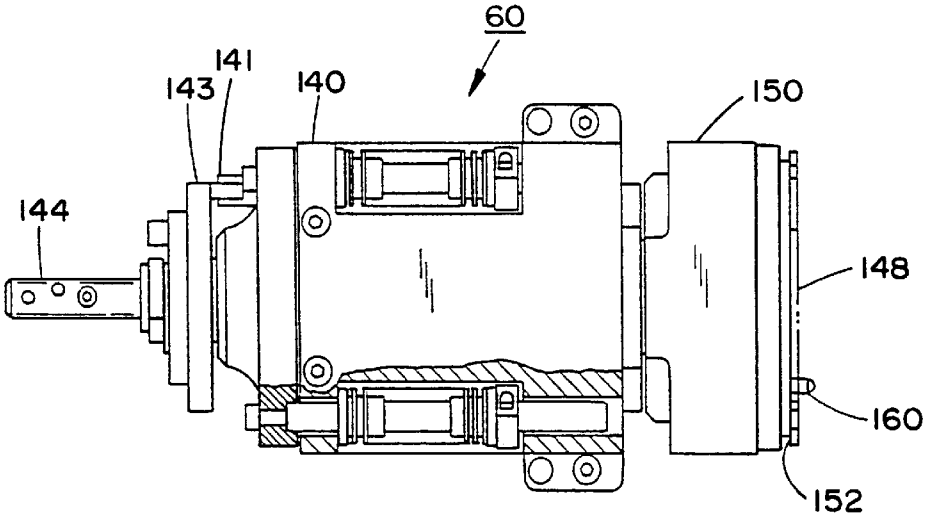
Figure 5:
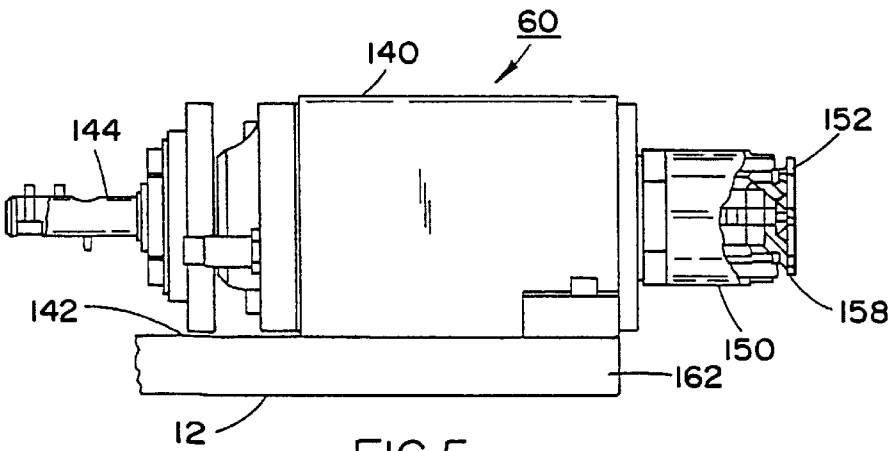

As shown in FIGS. 4 through 6, each tool nest 60 includes a housing 140 which is fixedly mounted on the upper surface 142 of the rotary turret 12. Each housing 142 includes a horizontal radially extending central through bore having a shaft 144 rotatably journaled therein. The shaft 144 is normally secured against rotation within housing 140; however, at predetermined workstations of the machine, the shaft 144 may be released by means of a locating pin 141 so as to be axially radially inwardly movable within housing 140 against stationary cam structure 143 mounted centrally on the rotary turret or dial 12 for regulating the rotational displacement which may be imparted to the shaft 144, as discussed hereinbelow in more specific detail.

The radially outwardly facing structure 148 of a plate element 150, which is fixedly secured to the radially outer end of shaft 144, is adapted for supporting suture package components, and particularly the package trays which are utilized in the production of surgical needle and attached suture-containing packages.

In essence, the radially outer structure of the tool nest housing 140 for mounting suture trays includes the plate element 150 which comprises an elongate vertically oriented plate member 152 having generally parallel opposite sides 154 and convexly rounded opposite ends 156 so as to be generally in conformance with the peripheral shape of a package tray. An external planar surface on the plate member 152 includes protruding perimeter or rim structure 158 5 for seating engagement therein of a suture tray, with the plate member 152 being fixedly secured to the radially outer end of the shaft 144 so as to be adapted for rotation therewith. Extending forwardly from the external planar surface of the rotatable plate member 152 of the tool nest 60 are protuberances or guide pins 160 which are intended to align the package tray thereon for appropriate positioning on the plate member 152, with the tray adapted to be retained thereon through the application of a vacuum to the exterior plate member surface through passageways communicating with a vacuum source connected thereto through the tool nest housing 140.

Figure 7:
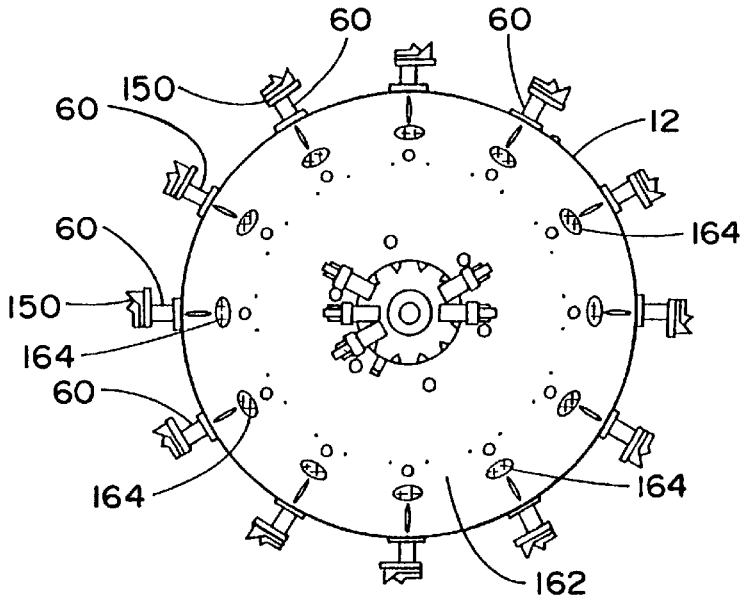
FIG. 7 illustrates a bottom view of the dial or turntable showing the vacuum ports for supplying the tool nests of the packaging machine with a controlled vacuum.
Figure 8:
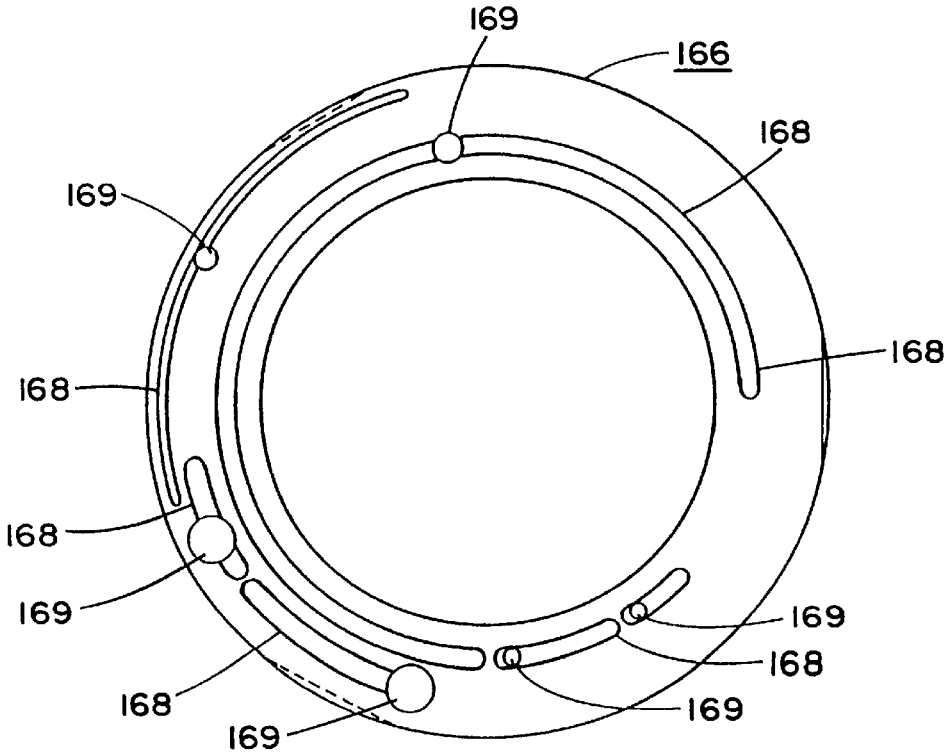
FIG. 8 illustrates a vacuum plenum for imparting vacuum conditions to the tool nests of FIG. 7 during operation of the packaging machine.

The vacuum passageways extend through the lower surface 162 of the dial or turntable 12, as shown in FIG. 7, which includes a plurality of apertures 164 each communicating with, respectively, passageways leading to an associated tool nest 60. The vacuum is supplied to the apertures 164 in a selective controlled mode through the intermediary of a stationary vacuum plenum 166 arranged below the dial 12, as shown in FIG. 2 of the drawings. The plenum 166, as shown in FIG. 8, includes outlet slots 168 and ports 169 for applying or closing a vacuum to respective tool nests 60 in accordance with the rotational positions of the dial 12 with the aperture or ports 164 in the lower surface 162 being in communication with the vacuum plenum outlet slots or ports.

Figure 9:
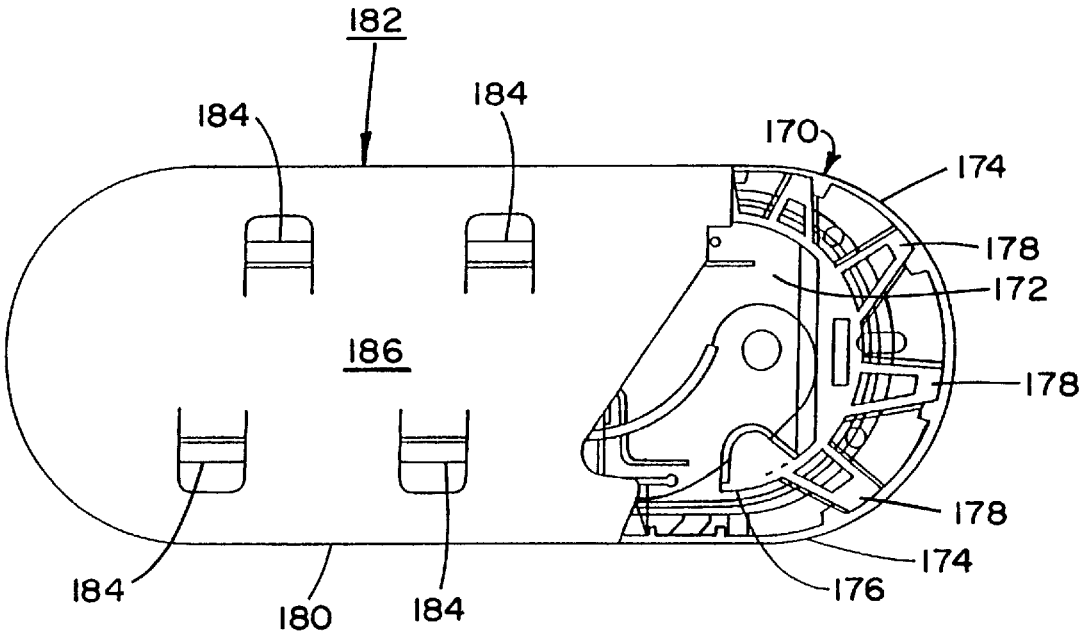
FIG. 9 illustrates a front view of a completed suture package as produced by the packaging machine.

The suture package tray 170, as shown in FIG. 9 of the drawings, is essentially constituted of molded plastic material, and includes a planar base 172 with parallel sides and semi-circular rounded ends. A vertical wall 174 extends about the perimeter of the tray, while inwardly spaced thereof is a second vertical wall 176 having radially outwardly extending fingers 178 which are flexible at the upper edge reaching close to the outer wall 174 so as to define a hollow channel structure. Apertures and surgical needle engaging structure is molded into the tray, as more specifically disclosed in copending U.S. patent application Ser. No. 08/521,978; filed Aug. 31, 1995 (Attorney Docket ETH-1088; D-9570), the disclosure of which is incorporated herein by reference, and which is commonly assigned to the assignee of this application.

The packaging tray 170 is shown with the cover 180 having been applied thereto so as to produce a complete suture package 182 having a single needle and attached suture arranged therein. The cover 180 extends over only a portion of the packaging tray area so as to afford visual inspection of the contents of the suture package. Interengageable latching structure 184, such as cut-outs and flaps, formed on the cover and package tray ensure their latched engagement upon application of the cover 180 to the packaging tray 170. The cover surface 186 may be provided with suitable printing whereby the cover, in essence, also constitutes a label for the suture package.

Reverting now more specifically to the description of the suture package unloading workstation 122 (10), reference may be had to drawing FIGS. 10 through 16. Basically, the components of the workstation 122 are supported on a stationary horizontal platform 190. The major components, as detailed hereinbelow are a robotic arm arrangement 192; elongate parallel movable racks comprising compartmented trays 194 each possessing a plurality of compartments 196, which are adapted to each receive and stack a predetermined quantity of completed suture packages 182 which have been removed in succession by means of the robotic arm arrangement 192 from tool nests 60 on the turntable 12 of the packaging machine 10.

The compartmented trays 194 are each mounted so as to be slidable along parallel supports 200, 202 radially extending into proximity with and below the turntable 12 of the packaging machine.

Figure 10:
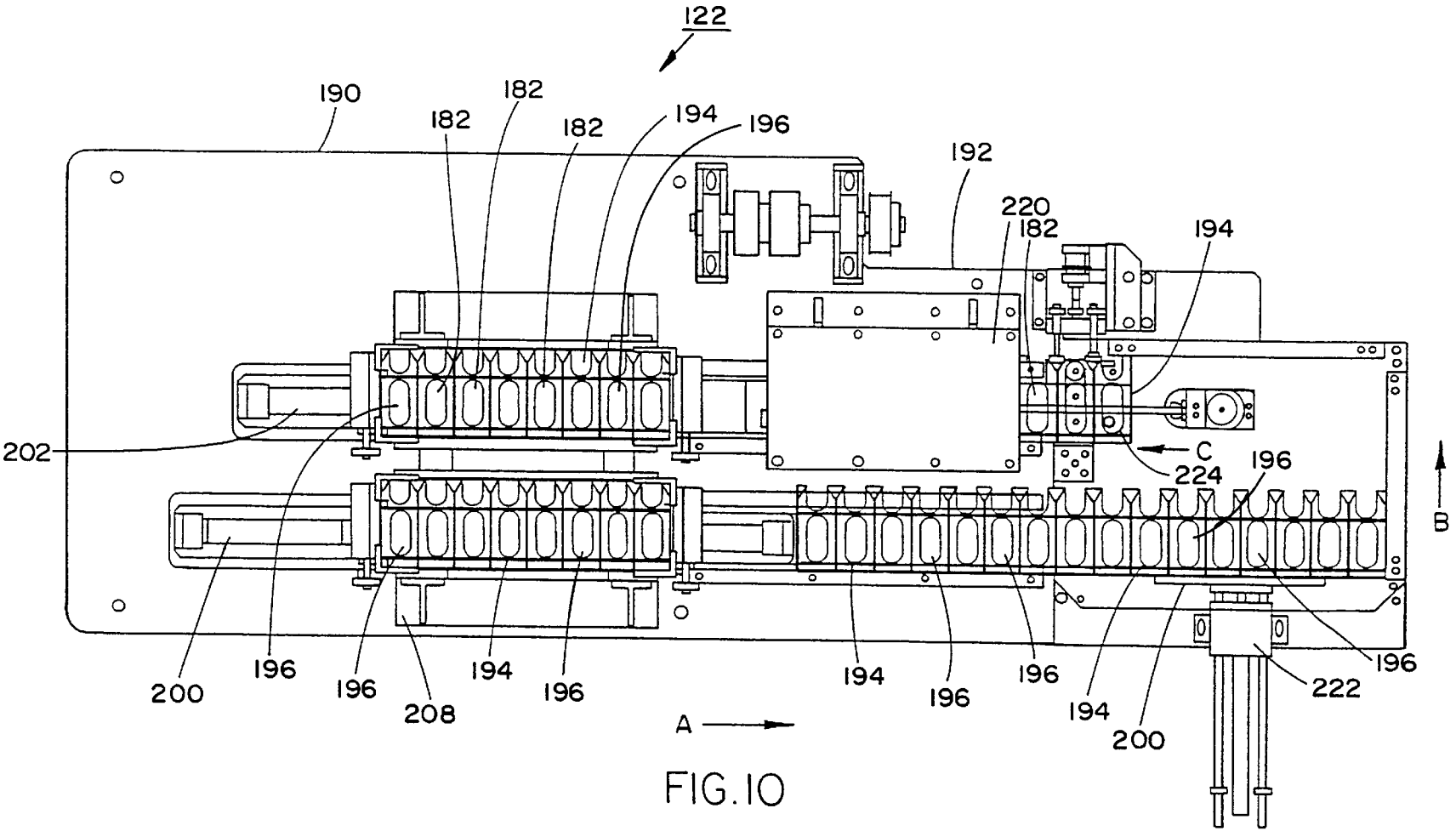
FIG. 10 illustrates a diagrammatic plan view of the suture package unloading arrangement.
Figure 11:
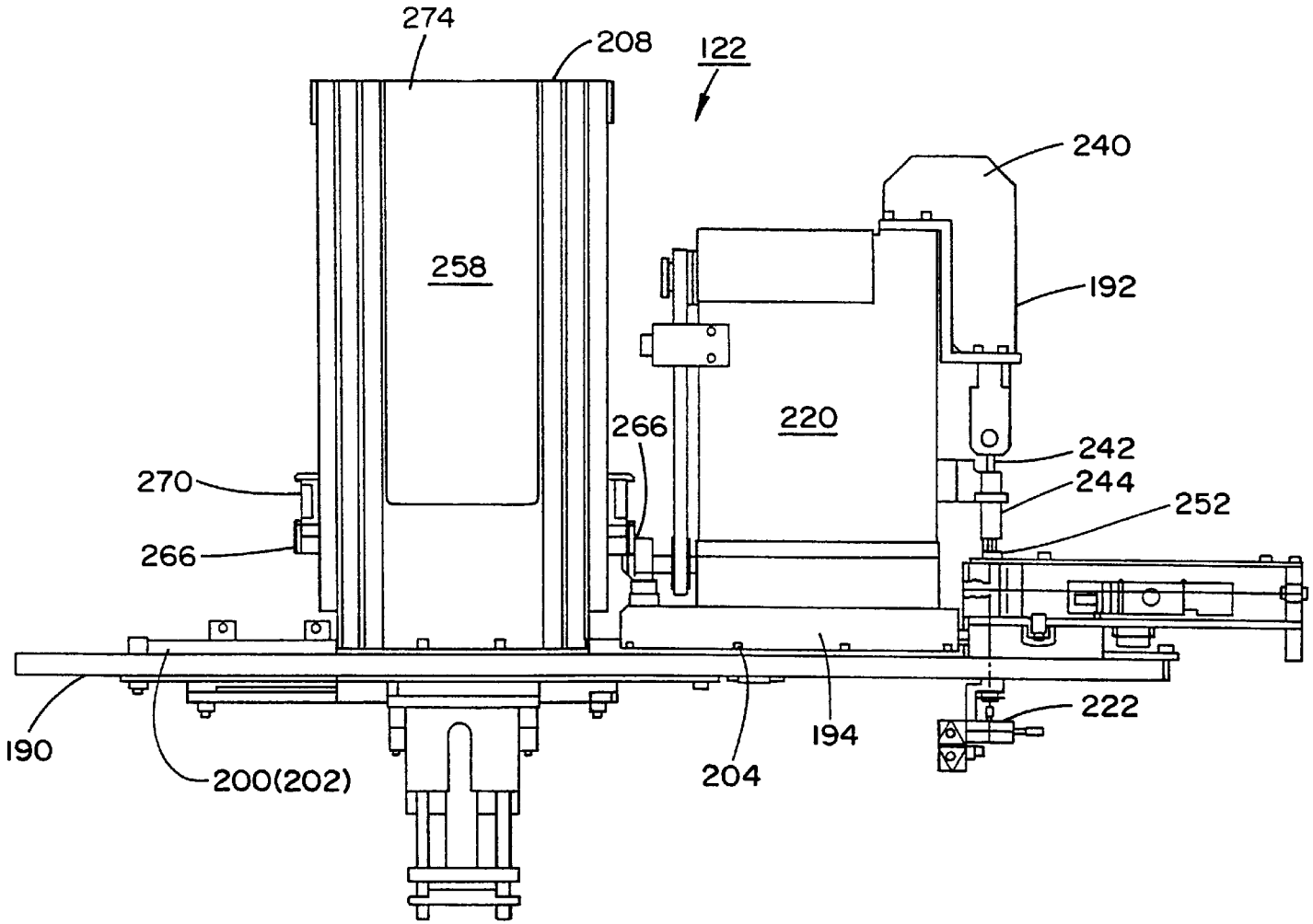
FIG. 11 illustrates a side elevational view of the suture package unloading arrangement of FIG. 10.
Figure 14:
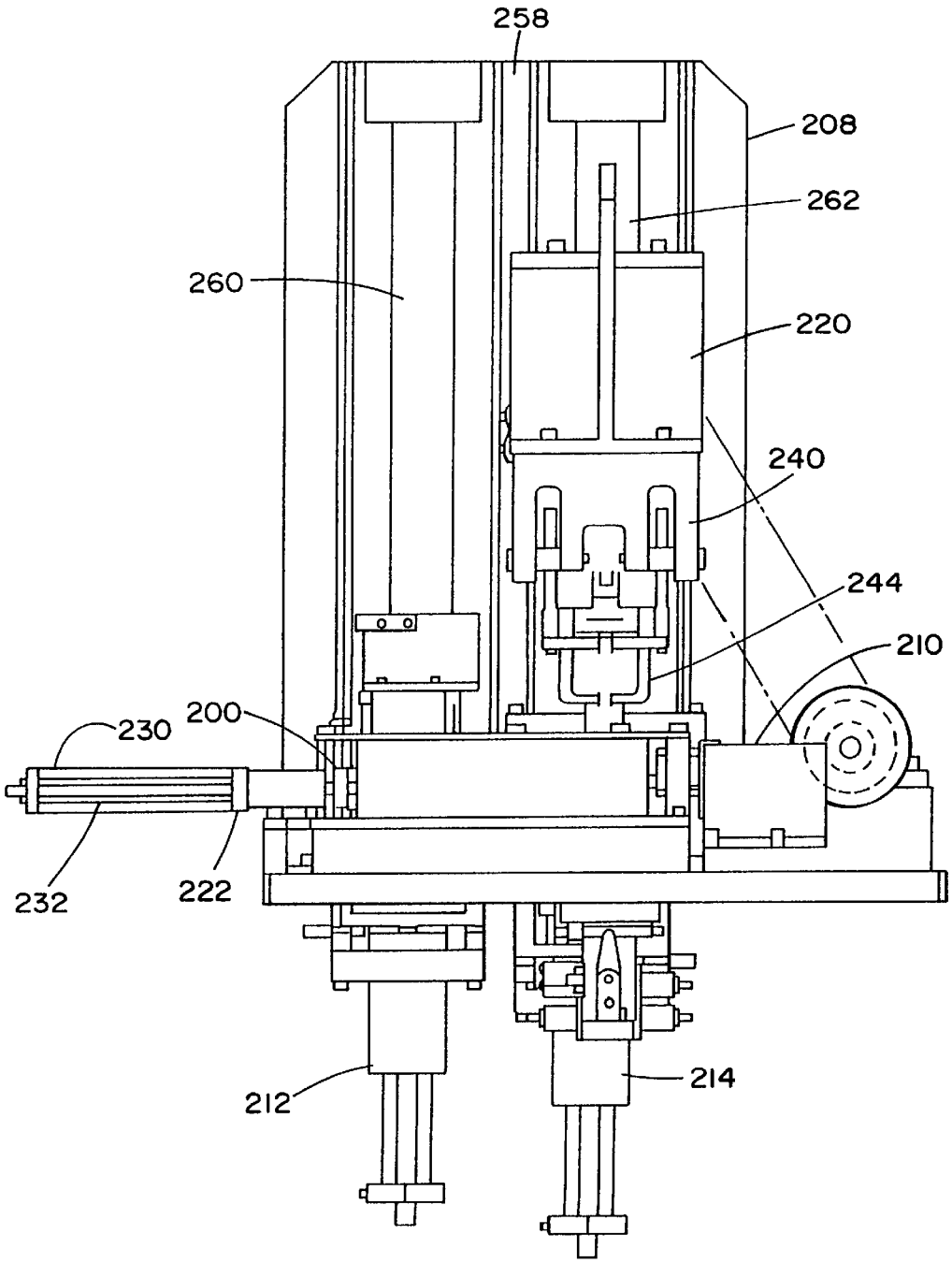
FIG. 14 illustrates a front end view of the arrangement of FIG. 11.
Figure 15:
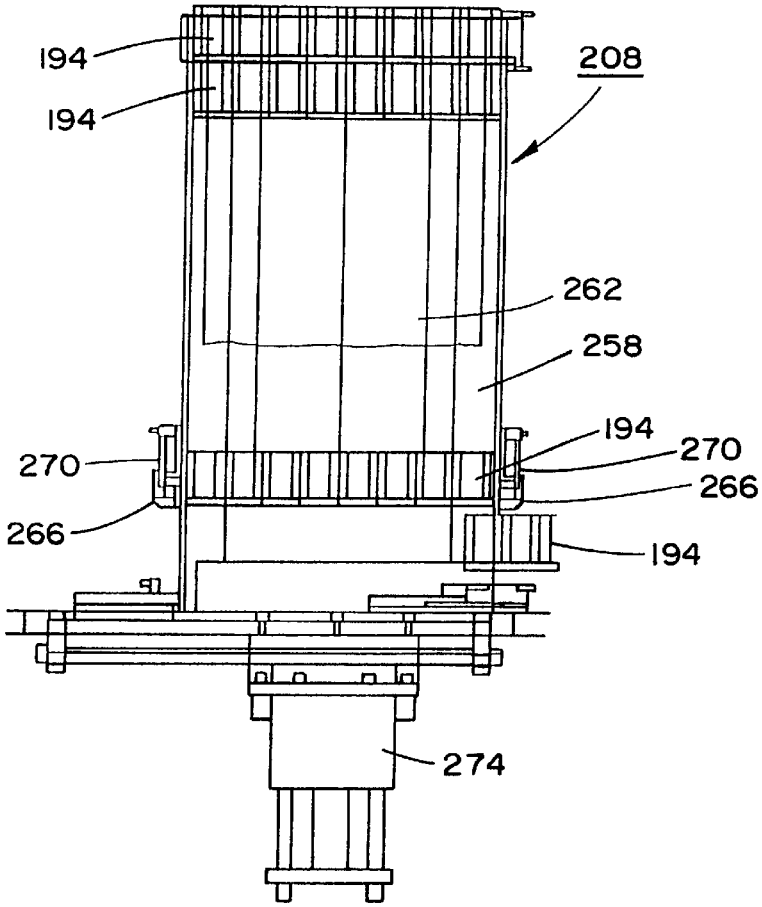
FIG. 15 illustrates, generally diagrammatically, a side elevational view of a storage housing portion of the arrangement of FIG. 11.
Figure 16:
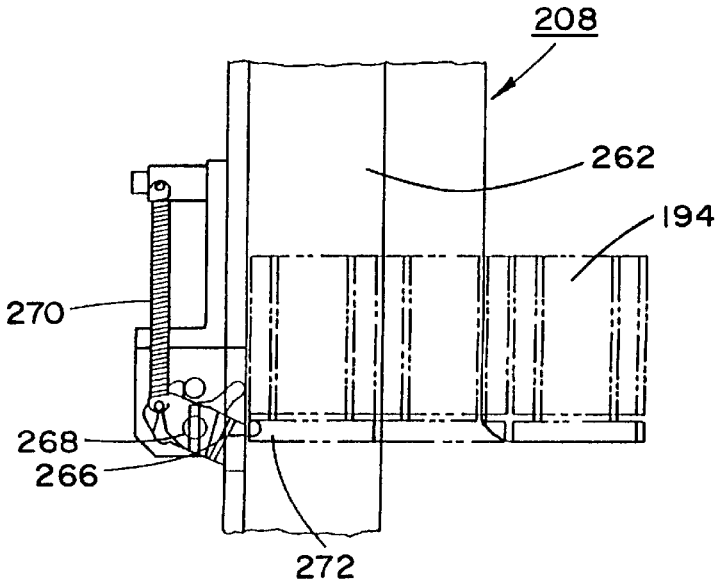
FIG. 16 illustrates, generally diagrammatically, a fragmentary segment of the storage housing portion of FIG. 15, showing a detail of the lifting device for compartmented trays containing suture packages.
Figure 17:
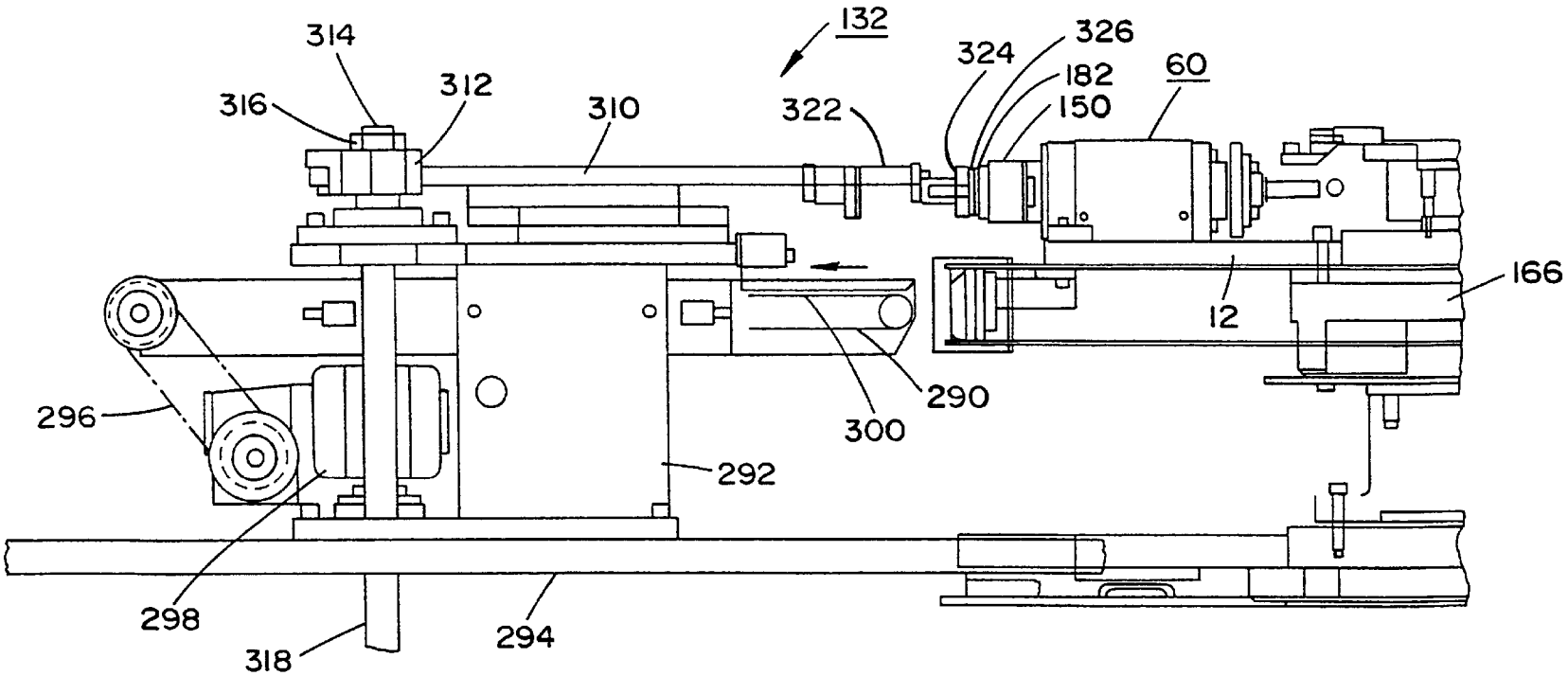
FIG. 17 illustrates, generally diagrammatically, a side view of an arrangement for removing rejected suture packages from the packaging machine.
Figure 20:
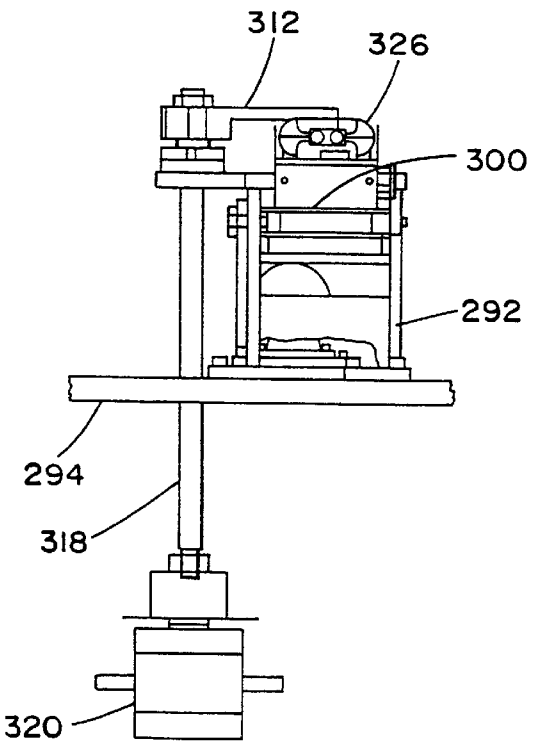
FIGS. 18, 19 and 20 illustrate, respectively, side, top plan and front end views in the detailed construction of the arrangement for removing the rejected suture packages from the packaging machine.
Figure 19:
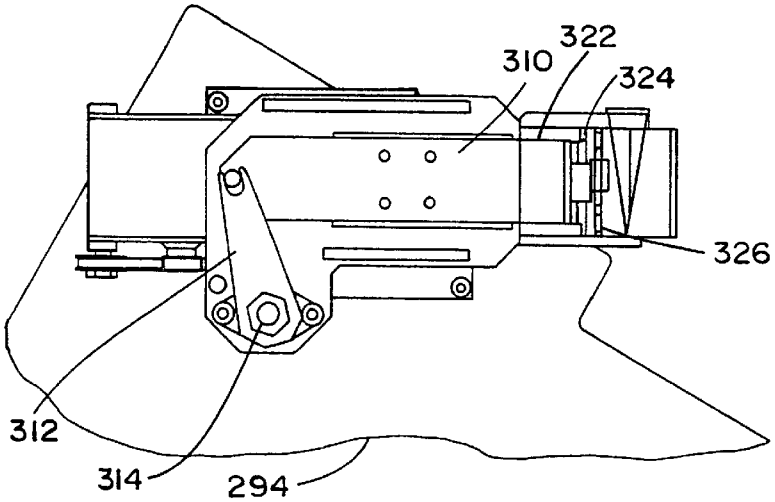
Figure 18:
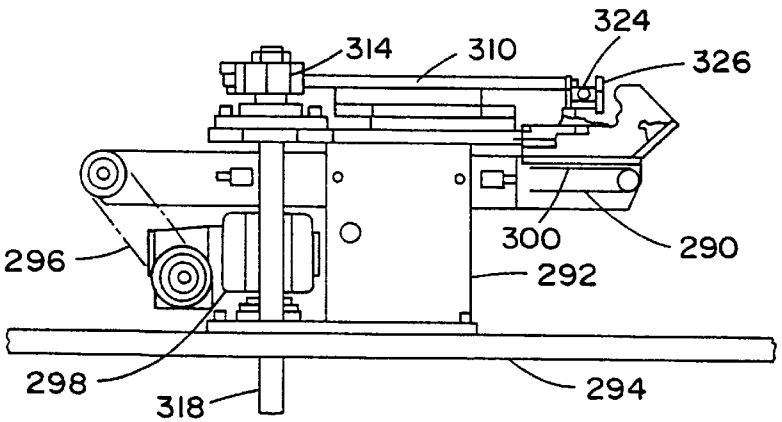

As can be ascertained from the drawing FIGS. 10 and 11, each compartmented tray 194 is movable along its longitudinal axis by means of tray-engaging elements 204 spaced along the bottom of each of the supports 200, 202. The slidable support 200 is adapted to convey empty of the compartmented trays 194 towards the turntable 12. The slidable support 202, conversely, is adapted to index compartmented trays beneath the robotic arm arrangement 192 for filling the compartments 196 with stacks of suture packages and then conveying the suture package-filled compartmented trays away from the turntable 12 for stacking in a storage 208 through the intermediary of an elevator mechanism 214. As shown in FIG. 14, the longitudinal or axial conveyance of slidable support 200 is implemented by a drive unit 212, whereas the indexing motion and conveyance of slidable support 202 is carried out through an indexing and drive unit (not shown) which is located below the platform 190.

Referring more specifically to FIGS. 11 through 14, the robotic arm arrangement 192 is located above the slidable support 202 and includes a housing 220 straddling the support 202, with the housing being arranged intermediate the compartmented tray storage 208 and the turntable 12 of the packaging machine 10, in effect along the path of axial movement or travel of the compartmented trays 194 which are being filled with suture packages 182 and transported to the storage 208.

In essence, a continuous sequence of empty compartmented trays 194 are adapted to be advanced forwardly along a path of travel towards turntable 12 (not shown) as shown by arrow A in FIG. 10 so that a forwardmost compartmented tray is in position adjacent a pusher plate 200 of drive mechanism 222 for displacing the forwardmost compartmented tray 194 laterally in the direction of arrow B. When a compartmented tray 194 has its most rearward compartment 224 located in alignment with the robotic pivot arm arrangement 192, the compartment is successively supplied with a predetermined quantity of suture packages 182; i.e. such as ten (10) packages. At that point, the compartmented tray is indexed in the direction of arrow C by a distance of one compartment 224 so as to enable the following compartment to be filled with suture packages 182. This sequence is repeated until all of the compartments have been filled with suture packages, whereupon the filled compartmented tray is advanced towards the storage 208, as described hereinbelow. At that time, the forwardmost compartmented tray 194 on the slidable support 200 is laterally displaced by the pusher plate 220 which slides along support rods 230, 232 adjacent a piston unit 234 of the drive mechanism 222 so as to locate the rearwardmost compartment 224 thereof below the robotic pivot arm arrangement 192. Thereupon, the filing cycle for the compartmented tray 194 is repeated as heretofore, while a successive empty compartmented tray 194 is advanced forwardly along arrow A so as to positioned adjacent the retracted pusher plate 200.

Reverting to the construction of the robotic pivot arm arrangement 192, the housing 220 incorporates driving mechanism (not shown) located in housing portion 240 having a depending arm 242 with a pivotable arm device 244 for conveying suture packages 182 from therewith aligned tool nests 60 (not shown) into the compartments 224 of the compartmented trays 194.

Figure 13:
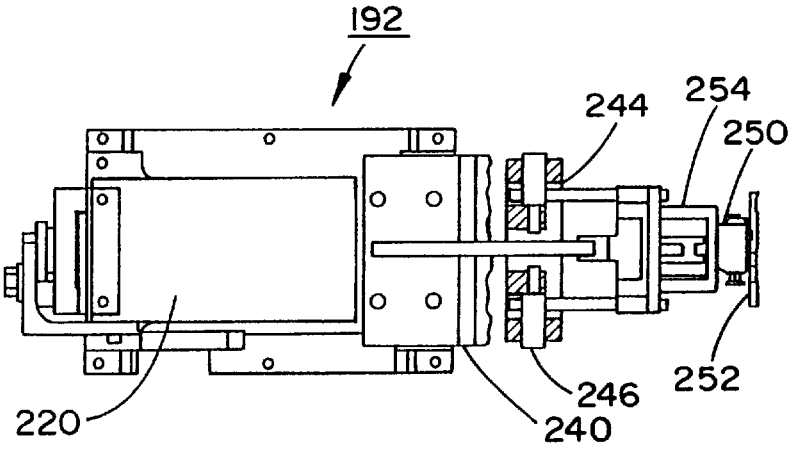
FIG. 13 illustrates a top plan view of the robotic pivot arm portion of FIG. 12, shown with the pivot arm in the horizontally upward pivoted position.
Figure 12:
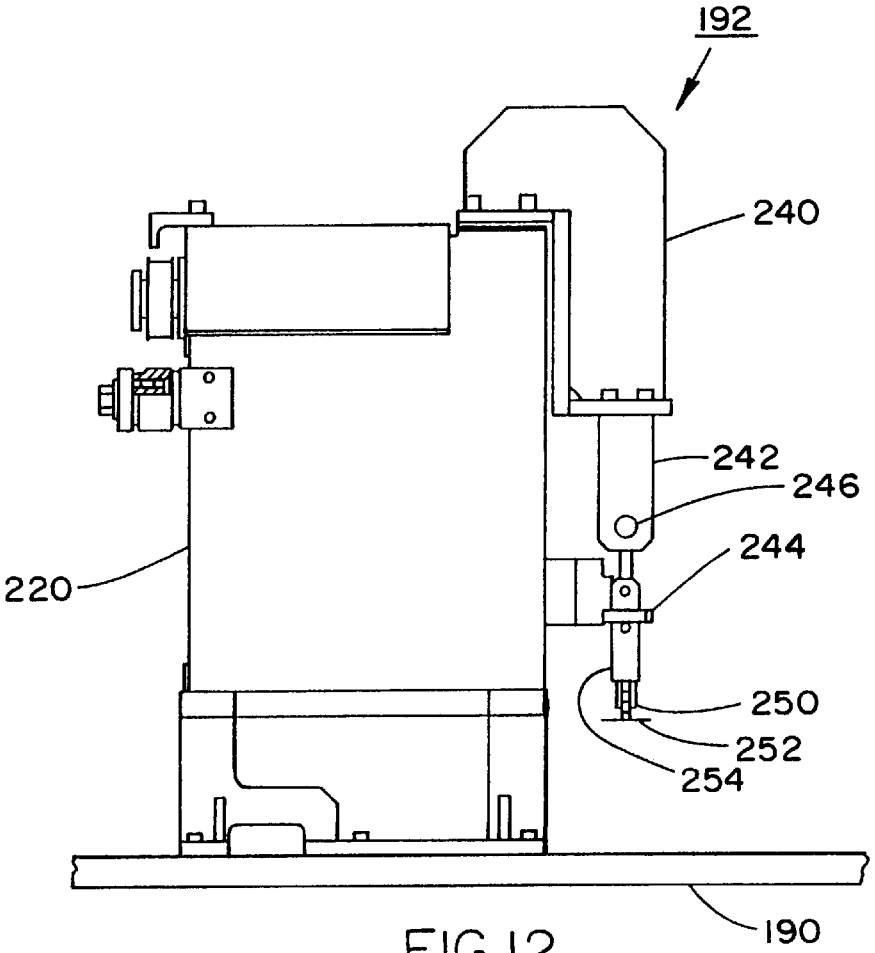
FIG. 12 illustrates a side elevational view of the robotic pivot arm portion of the arrangement of FIG. 11.

The robotic pivot arm arrangement 192 has pivot arm device hinged for swinging and axial movements at hinge point 246 so as to be oriented downwardly, as shown in FIGS. 11 and 12 for depositing suture packages 182 into the compartments of the compartmented trays 194, or extended horizontally for reciprocation, as shown in FIG. 13. During that horizontally oriented axial reciprocatory movement, the pivot arm device is adapted to remove suture trays 182 from the plate element 150 on a therewith aligned tool nest 60. The free or distal end 250 of the pivot arm device 244 includes a gripper attachment 252. Upon a suture package 182 being arranged on the tool nest 60 which is located at this workstation of the turntable 12, the arm 254 is horizontally oriented and extended towards the tool nest 60 so as to have the gripper attachment 252 contact the suture package 182. While the vacuum retaining the suture package 182 on the tool nest 60 is concurrently released, the suture package 182 is withdrawn from the tool nest 60 by the pivot arm 254.

The pivot arm 254, with the suture package 182 adhering to the gripper attachment 282 is then retracted and pivoted downwardly, as shown in FIGS. 11 and 12, whereupon the gripper is released so as to enable the suture package 182 to drop into a compartment 224 located therebeneath. The turntable 12 is concurrently indexed forwardly, as shown in FIG. 1, so as to permit a successive tool nest 60 mounting a completed suture package 182 to be positioned at the package unloading workstation, and the pivot arm 254, which has already released the previous suture package 182 is swung upwardly into its horizontal position and extended forwardly so as to contact the suture package 182 located on that tool nest 60, and the gripper 252 while the vacuum in tool nest 60 is released as heretofore. Then, as previously, the pivot arm is retracted, swung downwardly and the gripper 252 released so as to enable the suture package 182 to drop into the compartment 224 therebelow in superposition on the previous suture package or, alternatively, if the compartment is full and the compartmented tray 194 has been indexed forwardly by one compartment in the direction indicated by arrow B in FIG. 10, to cause the suture package to drop into an empty compartment.

Referring more specifically to FIGS. 10 through 15, the filled compartmented trays 194 each of which; for example, may have a series of eight compartments 224 each having ten suture packages 182 stacked therein, are successively conveyed by slidable support 202 to a position below the storage 208. The storage 208 consists of an open housing structure 258 having two adjacently arranged vertically-extending chutes 260, 262, one of which is adapted to have empty compartmented trays 194 stacked therein, and the other receives filled compartmented trays 194. The housing structure 258 has a lifting arrangement 260 connected therewith, which may be a pneumatic cylinder 212, as shown in FIG. 14, which raises the compartmented trays 194 in sequence, as diagrammatically illustrated in FIGS. 15 and 16. In that instance, pivotable fingers 266 which swing about pivot points 268 under the biasing action of tension springs 270, and which are connected to slidable frame elements 272 operated by a lift or hoisting drive 274, raise the filled compartmented trays 194 so as to facilitate further trays to be positioned therebelow. The stacks of filled compartmented trays 194 may then be manually removed from the open side 276 of housing structure 258; in effect, from chute 262, and empty trays 192 inserted into adjacent chute 260 so as to be lowered onto slidable support 200.

In the event that it has been previously ascertained; for example, through suitable sensor means or the like, that a suture package 182 located on a tool nest 60 is either incomplete or defective; rather than the suture package being removed at the unloading workstation, the defective suture package 182 is allowed to be advanced on its tool nest 60 by the turntable 12 to a subsequent reject workstation 130 (11), at which a reject arrangement 132 is adapted to remove the defective or incomplete suture package 182 from the packaging machine 10, referring to FIGS. 17 through 20 of the drawings.

The arrangement 132 for removing defective suture packages 182 comprises a conveyor belt 290 supported on a stationary frame structure 292 having a base plate 294. The conveyor belt 290 is connected to a belt drive 296 operated by a driving motor 298 which imparts a continuous motion to the conveyor belt so that the upper run 300 thereof travels in the direction of the arrow; in effect, radially outwardly away from turntable 12 and tool nest 60 mounting a rejected suture package 182 on plate element 150.

Located above the conveyor belt 290 is an axially slidable member 310 which is reciprocable towards and away from the suture package 182 responsive to the pivoting action of a pivot arm 312 connected thereto at pivot point 314. A vertical shaft 314 has the upper end 316 connected to the pivot arm 312 and at its lower end 318 is connected to a drive unit 320 for imparting oscillatory rotational movement thereto.

At the forward end 322 of slidable member 310, there is connected a head portion 324 having elements 326 adapted to engage the suture package 182 in the forwardly advance position of slidable member 310. Upon engaging the suture package 182, the vacuum in the tool nest 60 is released, thereby enabling the elements 326 to grasp the package 182, the slidable member 310 to retract by means of the pivoting of shaft 314 to swing pivot arm 312 backwards. The elements 326 on head portion 324 then release the suture package 182 so that the latter drops onto the upper run 300 of the conveyor belt 290 so as to be conveyed towards a waste disposal location. The foregoing operation is continually repeated for each tool nest 60 coming into alignment with workstation 130, even if no suture package 180 is located at that workstation, so as to ensure that any suture package will be prevented from passing this workstation, and thereby the machine will always be ready to continue in successive complete packaging sequence or cycle for producing suture packages.

While there has been shown and described what are considered to be preferred embodiments of the invention, it will, of course, be understood that various modifications and changes in form or detail could readily be made without departing from the spirit of the invention. It is, therefore, intended that the invention be not limited to the exact form and detail herein shown and described, nor to anything less than the whole of the invention herein disclosed as hereinafter claimed.

What is claimed is:

1. A suture package unloading arrangement in a machine for automated packaging of a single needle having an attached suture to produce a suture package, wherein said machine includes automatically winding said suture within a confine of a tray and attaching a cover to said tray so as to constitute said suture package, said machine having at least one tool nest for supporting said tray, and means for imparting a forwarding motion to said tool nest and said tray supported thereon for indexed advance to a plurality of workstations stationarily arranged proximate a path of advancing movement of said at least one tool nest; said arrangement comprising:

(a) a first workstation including motive means for engaging said suture package located on a support surface of said at least one tool nest; compartmented tray means having a plurality of compartments being positionable at said workstation below said motive means, said motive means being actuatable to disengage said suture package from said support surface and convey said suture package into a respective said compartment.

2. An arrangement as claimed in claim 1, wherein said plurality of compartments are formed in a linear array on said compartmented tray means, said motive means introducing a predetermined quantity of said suture packages into each said compartment; and means for indexing said compartmented tray means responsive to a compartment being filled with said predetermined quantity of suture packages so as to align an adjacent said compartment of said compartmented tray means for the conveyance thereto of suture packages by said motive means.

3. An arrangement as claimed in claim 2, wherein drive means replaces the compartmented tray means having the compartments thereof filled with said suture packages with a second empty said compartmented tray means.

4. An arrangement as claimed in claim 3, wherein said drive means shifts said second compartmented tray means laterally perpendicularly to a longitudinal indexing axis for said compartmented tray means.

5. An arrangement as claimed in claim 1, wherein said motive means comprise a cam-controlled pivot arm.

6. An arrangement as claimed in claim 5, wherein drive means activate said pivot arm between an elevated horizontal orientation for movement towards and away from said suture package to a downwardly pivoted position above a respective one of the compartments of said compartmented tray means.

7. An arrangement as claimed in claim 6, wherein an outer end of said pivot arm includes a pneumatically operated gripper.

8. An arrangement as claimed in claim 7, wherein an air supply is applied to said gripper upon contact thereof with the suture package on the support surface on said at least one tool nest causing said gripper to grasp said suture package, said air supply being maintained to transfer the suture package to said pivot arm from said support surface while releasing a vacuum in said tool nest, means pivoting said pivot arm downwardly over one said compartment and removing said air supply to said gripper thereby releasing said package from said gripper to permit the suture package to drop into the compartment located therebelow.

9. An arrangement as claimed in claim 1, wherein a rejected suture package is retained on the support surface of said at least one tool nest for conveyance to a second workstation, and means at said second workstation for withdrawing said rejected suture package from the support surface of said tool nest.

10. An arrangement as claimed in claim 9, wherein said withdrawing means includes a reciprocating member for movement towards and away from said at least one tool nest; and gripper means on a leading end of said reciprocating member for graspingly engaging and withdrawing a rejected suture package from said tool nest.

11. An arrangement as claimed in claim 10, wherein a conveyor belt is located below said reciprocating member, said gripper means releasing said rejected suture package so as to drop onto said conveyor belt for transport to a disposal site.

12. A suture package unloading method for a machine for automated packaging of a single needle having an attached suture to produce a suture package, wherein said machine includes automatically winding said suture within a confine of a tray and attaching a cover to said tray so as to constitute said suture package, said machine having at least one tool nest for supporting said tray, and imparting a forwarding motion to said tool nest and said tray supported thereon for indexed advance to a plurality of workstations stationarily arranged proximate a path of advancing movement of said at least one tool nest; said method comprising:

(a) at a first workstation having motive means for engaging said suture package located on a support surface of said at least one tool nest; compartment tray means having a plurality of compartments being positionable at said workstation below said motive means, said motive means being actualable to disengage said suture package from said support surface and convey said suture package into a respective said compartment.

13. A method as claimed in claim 12, wherein said plurality of compartments are formed in a linear array in said compartmented tray means, said motive means introducing a predetermined quantity of said suture packages into each said compartment; and indexing said compartmented tray means responsive to a compartment being filled with said predetermined quantity of suture packages so as to align an adjacent said compartment of said compartmented tray means for the conveyance thereto of suture packages by said motive means.

14. A method as claimed in claim 13, wherein drive means replaces the compartmented tray means having the compartments thereof filled with said suture packages with a second empty said compartmented tray means.

15. A method as claimed in claim 14, wherein said drive means shifts said second compartmented tray means laterally perpendicularly to a longitudinal indexing axis for said compartmented tray means.

16. A method as claimed in claim 12, wherein said motive means comprise a cam-controlled pivot arm.

17. A method as claimed in claim 16, wherein drive means actuate said pivot arm between an elevated horizontal orientation for movement towards and away from said suture package to a downwardly pivoted position above a respective one of the compartments of said rack means.

18. A method as claimed in claim 17, wherein an outer end of said pivot arm includes a pneumatically operated gripper.

19. A method as claimed in claim 18, wherein an air supply is applied to said gripper upon contact thereof with the suture package on the support surface on said at least one tool nest causing said gripper to grasp said suture package, said air supply being maintained to transfer the suture package to said pivot arm from said support surface while releasing a vacuum in said tool nest, means pivoting said pivot arm downwardly over one said compartment and removing said air supply to said gripper thereby releasing said package from said gripper to permit the suture package to drop into the compartment located therebelow.

20. A method as claimed in claim 12, wherein a rejected suture package is retained on the support surface of said at least one tool nest for conveyance to a second workstation, and means at said second workstation withdrawing said rejected suture package from the support surface of said tool nest.

21. A method as claimed in claim 20, wherein said withdrawing means includes a reciprocating member for movement towards and away from said at least one tool nest; and gripper means on a leading end of said reciprocating member for graspingly engaging and withdrawing a rejected suture package from said tool nest.

22. A method as claimed in claim 21, wherein a conveyor belt is located below said reciprocating member, said gripper means releasing said rejected suture package onto said conveyor belt for transport to a disposal site.

* * * * *